US006811165B2

(12) United States Patent
Chang

(10) Patent No.: US 6,811,165 B2
(45) Date of Patent: Nov. 2, 2004

(54) BRAKE STRUCTURE OF SKATEBOARD

(76) Inventor: Tuan Chang, No. 42, Alley 6, Lane 100, Tung Kuang Yuan Road, Taichung (TW)

( * ) Notice: Subject to any disclaimer, the term of this patent is extended or adjusted under 35 U.S.C. 154(b) by 51 days.

(21) Appl. No.: 10/304,740

(22) Filed: Nov. 27, 2002

(65) Prior Publication Data

US 2004/0100056 A1 May 27, 2004

(51) Int. Cl.[7] ..... B62M 1/00

(52) U.S. Cl. ..... 280/87.041; 280/11.212; 188/330

(58) Field of Search ..... 280/87.01, 87.021, 280/87.041, 87.042, 11.204, 11.211, 11.212, 11.214; 188/19, 330, 325, 328

(56) References Cited

U.S. PATENT DOCUMENTS 1,804,929 A * 5/1931 Godfrey ..... 188/341
1,976,419 A * 10/1934 Taylor ..... 188/330
2,945,564 A * 7/1960 House et al. ..... 188/328
4,134,599 A * 1/1979 DiMille et al. ..... 280/87.01
4,183,546 A * 1/1980 Heilig ..... 280/87.042
5,351,974 A * 10/1994 Cech ..... 280/11.212
5,464,235 A * 11/1995 Goldman et al. ..... 280/11.212
6,237,725 B1 * 5/2001 Otterson et al. ..... 188/19
6,488,296 B2 * 12/2002 Ireton ..... 280/87.042
6,592,129 B1 * 7/2003 Gates ..... 280/11.204

FOREIGN PATENT DOCUMENTS

WO 94/06656 * 3/1994 ..... 280/11.212

* cited by examiner

*Primary Examiner*—Frank Vanaman
(74) *Attorney, Agent, or Firm*—Troxell Law Office PLLC

(57) ABSTRACT

A brake structure of a skateboard including: a casing having a cavity with an opening facing outward, the casing being fixedly disposed on an inner side of one end of the wheel shaft of the skateboard; two brake members pivotally connected in the cavity and movable between open and closed positions; a resilient member biasing the free ends of the brake members together; a rotary shaft having a driving section at one end, the rotary shaft being rotatably connected with the casing with the driving section positioned in the cavity, the free ends of the brake members touching two sides of the driving section; a rocking arm positioned on outer side of the casing and connected with the rotary shaft; a controlling assembly connected with the rocking arm; and a wheel disposed at one end of the rotary shaft. An annular wall projects from inner side of the wheel.

8 Claims, 5 Drawing Sheets

BRAKE STRUCTURE OF SKATEBOARD

BACKGROUND OF THE INVENTION

The present invention is related to a skateboard, and more particularly to a brake structure of a skateboard, which is hidden in the wheel of the skateboard without being exposed to outer side.

FIG. 1 shows a part of a conventional skateboard, especially a mountaineering skateboard. The skateboard includes a wheel shaft 10. The center of the wheel shaft 10 has a bracket 12. A wheel 14 is mounted at each end of the wheel shaft 10. A step board is fixed on top face of the bracket 12.

The mountaineering skateboard is used on a road face which is more irregular and inclined. In order to enhance the controllability and ensure safety, the skateboard is equipped with a manually controllable brake mechanism 16. Such brake mechanism is directly exposed to outer side. This leads to poor appearance. Moreover, when transferring or using the skateboard, a user is easy to be hit by the housing of the brake mechanism and get injured. In addition, when skating on an irregular road face, the exposed brake mechanism is likely to collide a protruding article and get damaged.

SUMMARY OF THE INVENTION

It is therefore a primary object of the present invention to provide a brake structure of a skateboard, which is hidden in the wheel of the skateboard. Accordingly, the appearance of the skateboard is beautified and a user is protected from colliding with and being injured by the brake structure.

It is a further object of the present invention to provide the above brake structure that is protected from colliding with and being damaged by articles projecting from a road face.

The present invention can be best understood through the following description and accompanying drawings wherein:

DETAILED DESCRIPTION OF THE PREFERRED EMBODIMENT

Figure 1:
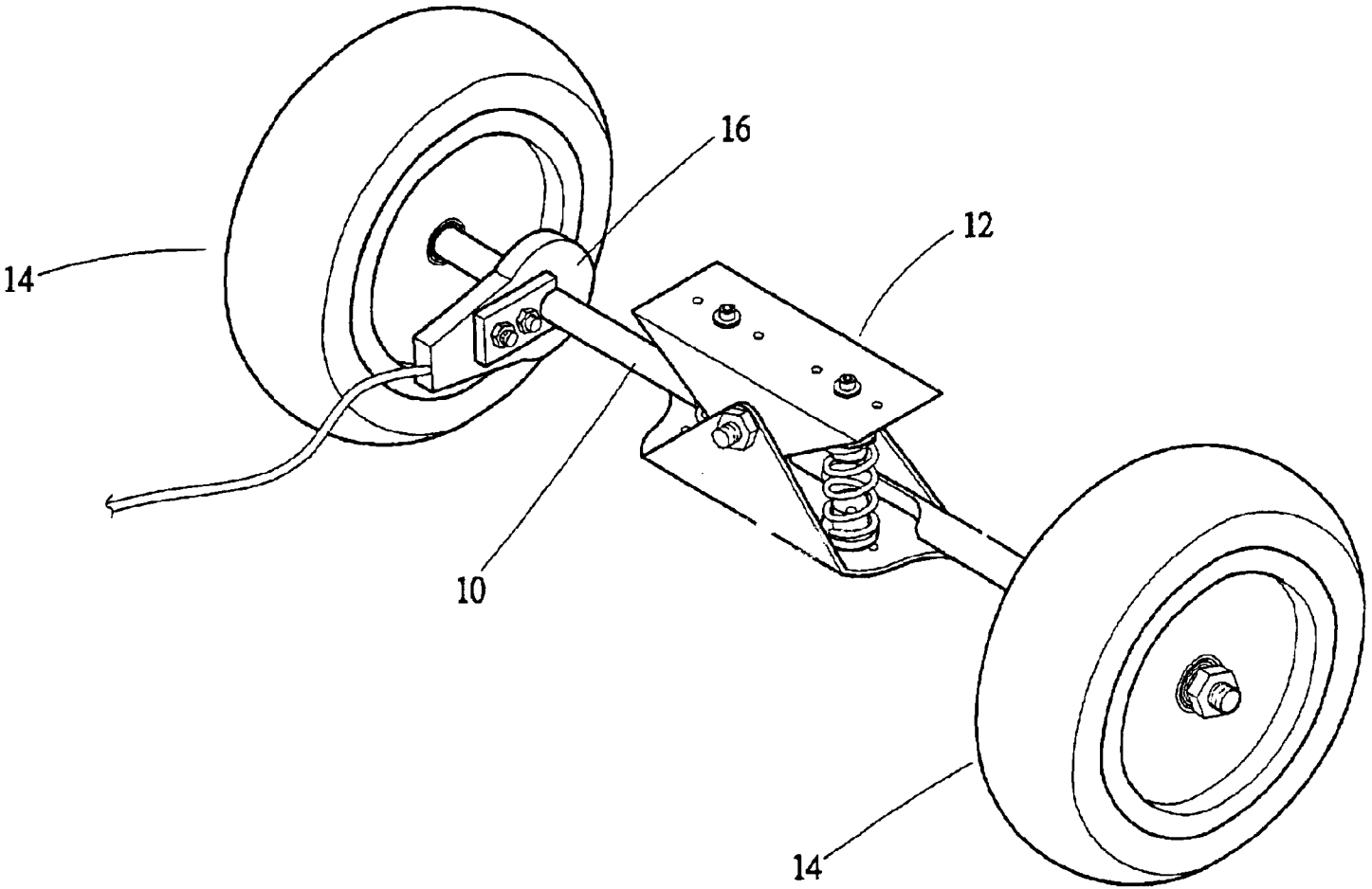
Fig. 1 PRIOR ART
FIG. 1 shows a part of a conventional skateboard.
Figure 2:
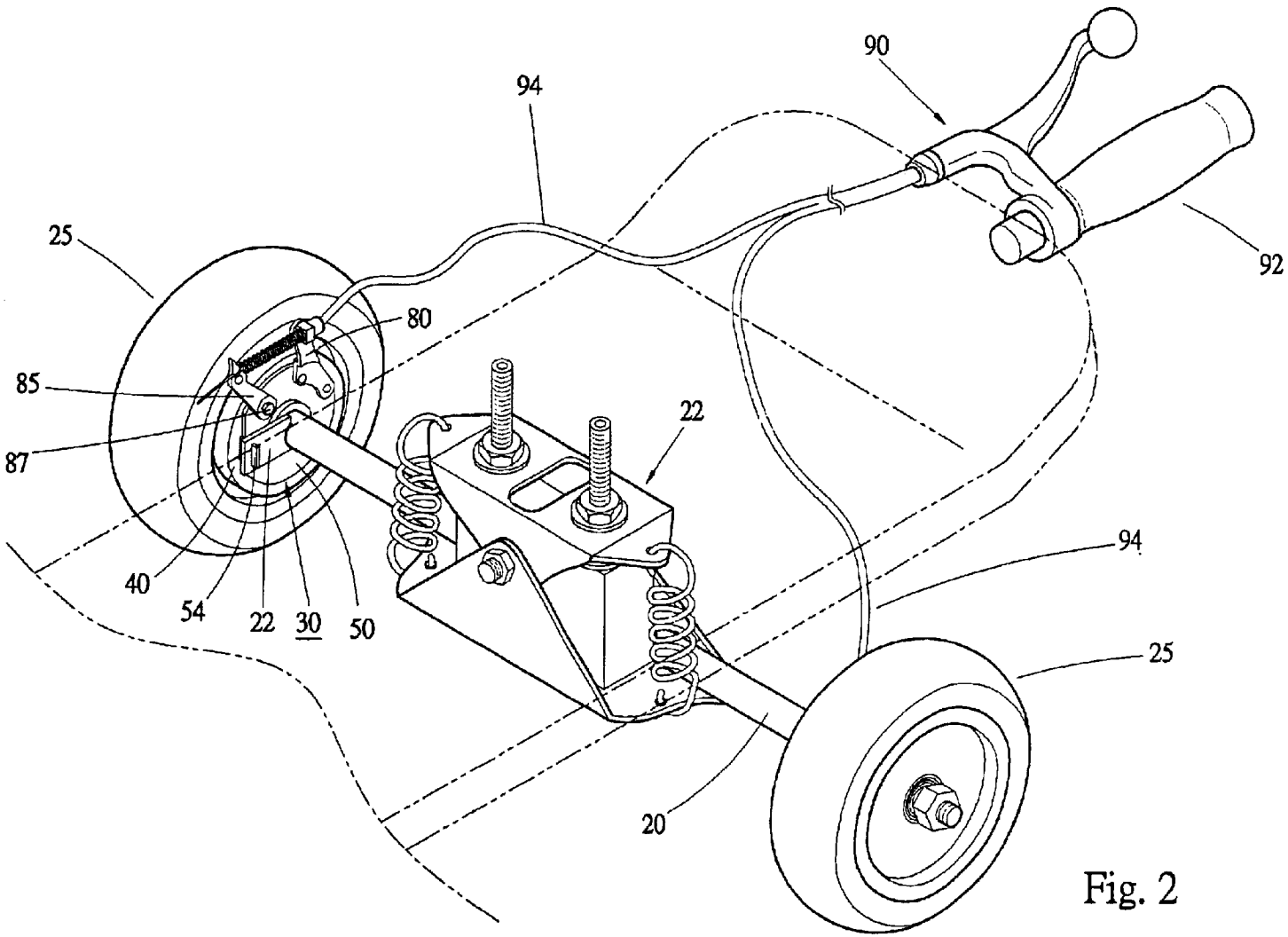
FIG. 2 is a perspective view of a part of the skateboard of a preferred embodiment of the present invention.
Figure 3:
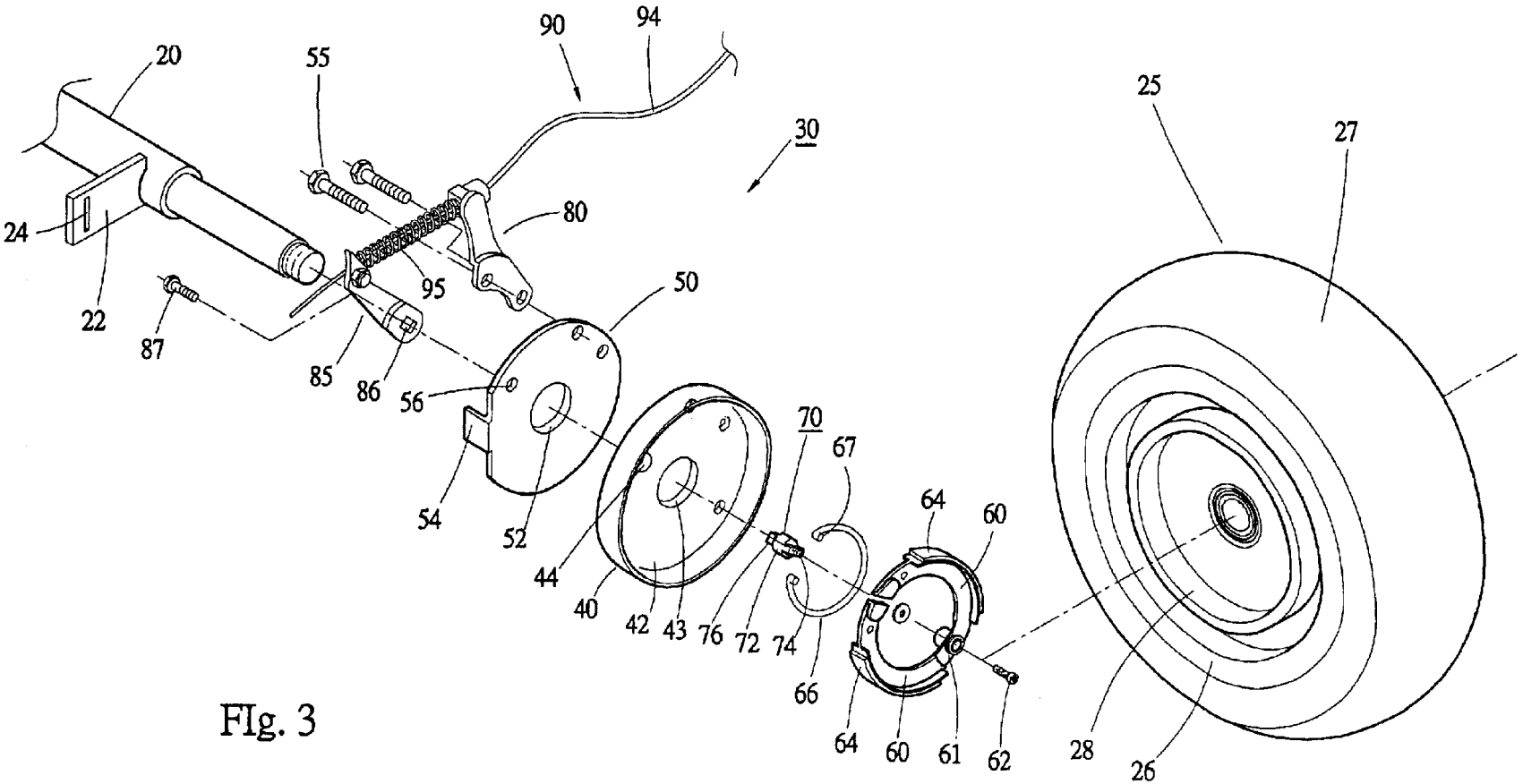
FIG. 3 is a perspective exploded view of the brake structure of FIG. 2.

Please refer to FIGS. 2 and 3. The skateboard of the present invention has two wheel shafts 20 (only one is shown). The center of each wheel shaft 20 has a bracket 22. A step board (as shown by phantom line of FIG. 2) is fixed on top face of the bracket 22. A wheel 25 is mounted at each end of the wheel shaft 20. In this embodiment, a brake structure 30 is mounted in the rim of the wheel.

The wheel 25 includes a rim 26 and a tire 27 mounted around the rim 26. An annular wall 28 projects from inner side of the rim 26. The wheel 25 is rotatably mounted at each end of the wheel shaft 20.

The brake structure 30 includes an annular casing 40 having a cavity 42 with an opening facing outward. The casing 40 has a through hole 43 through which one end of the wheel shaft 20 is fixedly fitted. The casing can be fixed on the wheel shaft by welding. Alternatively, the casing can be fixed on the wheel shaft in such a manner that a projecting plate 22 is fixed on inner side of one end of the wheel shaft. The brake structure 30 further includes a fixing member 50 which is a plate body formed with a through hole 52 through which the wheel shaft is fitted. The fixing member 50 has an insertion section 54 inserted in a slot 24 of the projecting plate 22 to prevent the fixing member from rotating. The casing 40 is fixedly connected with the fixing member 50 by screwed members 55, whereby the casing is fixed on the wheel shaft without rotating.

Figure 4:
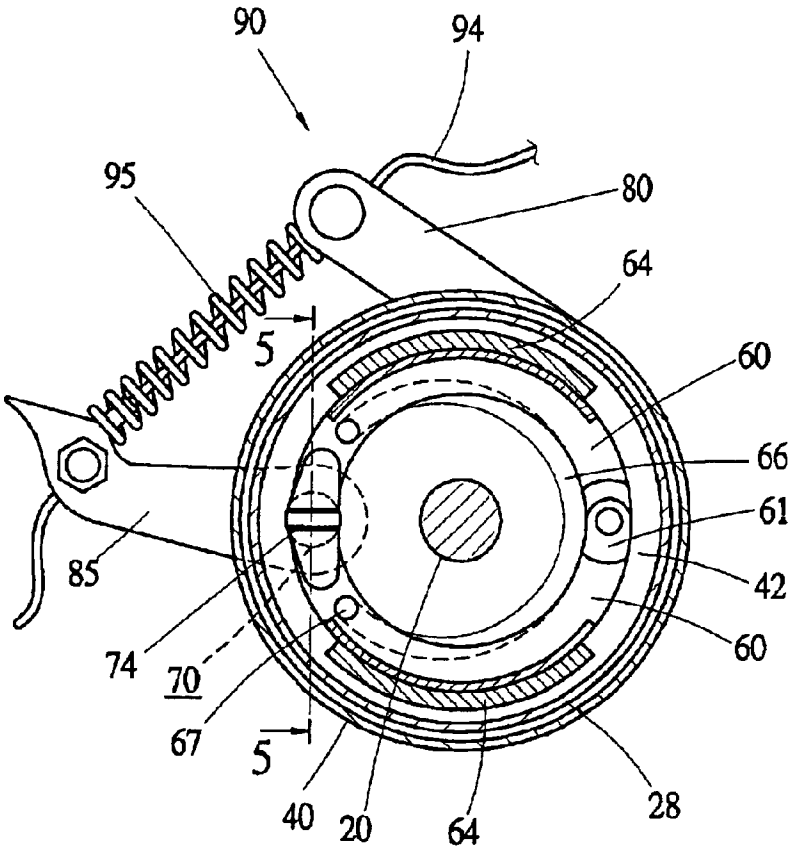
FIG. 4 is a sectional assembled view of the brake structure of FIG. 2, showing a not braked state.

The brake structure 30 further includes two brake members 60 which are arched bars oppositely arranged to form a circular pattern. The brake members 60 are accommodated in the cavity 42 of the casing 40 as shown in FIG. 4. One end 61 of each brake member 60 is pivotally connected with one end of the other brake member 60 by a rivet 62. Also, the two brake members 62 are riveted in the casing 40. Accordingly, the two brake members 60 can be pivoted on the rivet 62 about the pivoted ends 61 to open or close. Two brake linings 64 are respectively fixedly positioned on outer circumference of the brake members 60.

The brake structure 30 further includes a resilient member 66 received in the casing 40. Two ends 67 of the resilient member 66 are respectively inserted in the two brake members 60 as shown in FIG. 4. When not suffering external force, the resilient member 66 keeps the free ends of the brake members 60 close.

Figure 5:
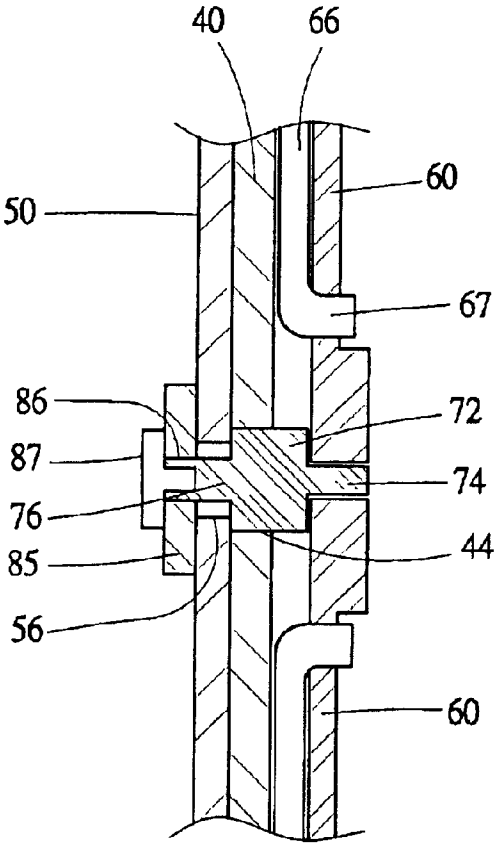
FIG. 5 is a sectional view taken along line 5—5 of FIG. 4.

The brake structure 30 further includes a rotary shaft 70 having a cylindrical body section 72. A rectangular bar-like driving section 74 protrudes from outer end of the body section 72. The lengthwise direction of the driving section is parallel to the diametric direction of the body section 72. A key section 76 projects from inner end of the body section of the rotary shaft 70. The outer diameter of the key section is smaller than that of the body section 72. The body section 72 of the rotary shaft 70 is rotatably fitted through the through hole 44 of the casing 40. The key section 76 extends through the through hole 56 of the fixing member 50. The diameter of the through hole 56 is smaller than that of the body section 72 as shown in FIG. 5 so that only the key section 76 is permitted to pass through the through hole 56, while the body section 72 cannot pass through the through hole. The end of the body section abuts against the fixing member and is located. The driving section 74 is positioned in the cavity 42 of the casing as shown in FIG. 4 and the free ends of the brake members 60 touch two sides of the driving section 74.

The brake structure 30 further includes a rocking arm 85. One end of the rocking arm is formed with a key hole 86 in which the key section 76 of the rotary shaft 70 is fitted. Accordingly, the rocking arm 85 is synchronously rotatable with the rotary shaft. A screw 87 is screwed in the key section 76 and abuts against outer side of the rocking arm, whereby the rocking arm will not separate from the key section and the rotary shaft is kept located in the through hole 44.

The brake structure 30 further includes a controlling assembly 90 including a support arm 80, a handle 92 and a steel cable. The support arm 80 is fixed on the casing 40 and the fixing member 50 by screwed members 55. The steel cable has two cords 94. One end of the cable is connected with the handle 92, while the other end of the cable is passed through each support arm 80 and fixedly connected with the rocking arm 85 for controlling swinging thereof. Two springs 95 are respectively fitted with the two cords 94 between the support arm and rocking arm to provide restoring force for the rocking arm.

When assembled, the casing 40 in which the controlling assembly 90 and the two brake members 60 are mounted in fixed at one end of the wheel shaft 20. Then the wheel 25 is mounted at one end of the wheel shaft to form a state as shown in FIG. 2. After mounted, the casing 40 covers the projecting wall 28 of the wheel 25 with the two brake members 60 accommodated in the cavity 42 as shown in FIG. 4. The two brake members 60 are positioned in the projecting wall 28.

In normal state, the two brake members 60 are biased by a resilient force of the resilient member 66 and are closed. The free ends of the brake members touch two sides of the driving section 74. In addition, the driving section 74 is in a horizontal state as shown in FIG. 4, keeping the brake members in a minimum closed state. At this time, the brake linings 64 are spaced from the inner face of the projecting wall 28 without creating brake effect and the wheel 25 can freely rotate.

Figure 6:
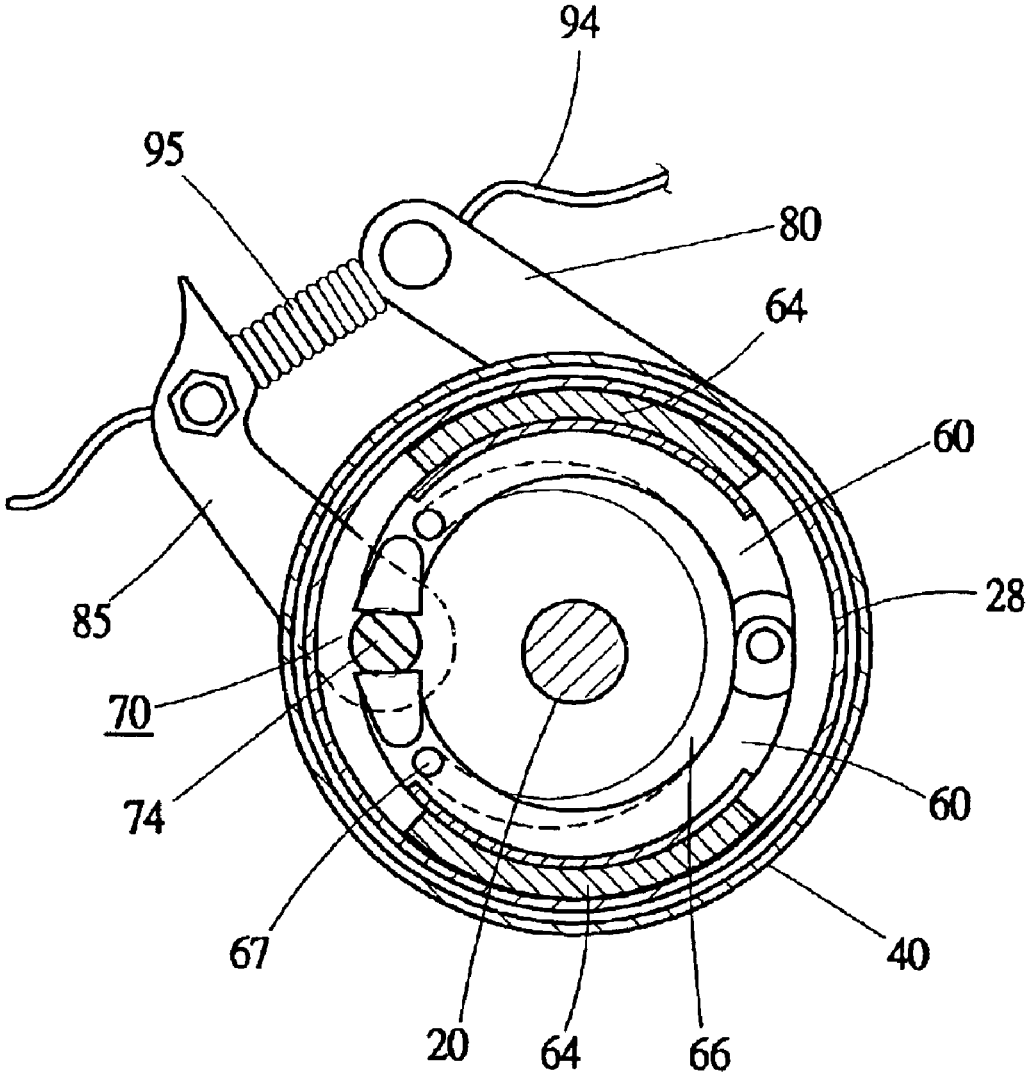
FIG. 6 is a sectional assembled view according to FIG. 4, showing a braked state.

When braked, a user presses the handle 92 to via the cords 94 pull the rocking arm 85 to swing toward the support arm 80 as shown in FIG. 6. When the rocking arm 85 swings, the rotary shaft 70 is driven to rotate, whereby the driving section 74 is angularly displaced. At this time, two ends of the driving section drive the free ends of the two brake members 60 to stretch open the brake members. Under such circumstance, the brake linings 64 touch the inner face of the projecting wall 28 to exert a frictional force against the wheel to create a brake effect.

After the handle 92 is released, the rocking arm 85 is pushed and restored by the spring 95 and the rotary shaft 70 is driven to rotate back to the position as shown in FIG. 4. At this time, the driving section 74 is restored and the two brake members 66 are restored to the state of FIG. 4 by the resilient member 66. Under such circumstance, the free ends of the brake members are re-closed to release the wheel from braking force.

According to the above arrangement, the brake structure of the skateboard is hidden in the wheel. Therefore, the structure of the skateboard is simplified and the appearance of the skateboard is beautified. Also, a user is protected from colliding with and being injured by the brake structure. In addition, the brake structure is protected from colliding with and being damaged by articles projecting from the road face.

What is claimed is:

1. A brake structure for a skateboard having two wheel shafts, and wheels mounted at two ends of each wheel shaft, the brake structure being mounted between a wheel and a wheel shaft for controlling a braking effect of the wheel, wherein the brake structure comprises:

a casing having a cavity with an opening facing outward, the casing being fitted on one end of the wheel shaft and located on an inner side of one end of the wheel shaft without rotating;

two brake members which are arched bars pivotally connected with each other and swingable in the cavity of the casing, the two brake members being oppositely arranged to form a circular pattern, free ends of the brake members being openable and closable, brake linings being respectively fixedly arranged on outer circumferences of the brake members;

a resilient member received in the cavity of the casing between the brake members, when the free ends of the brake members are not pressed outwardly by an external force, the resilient member moves the free ends of the brake members to a closed position;

a rotary shaft having a driving section at one end, the rotary shaft being rotatably disposed in the casing, the axial direction of the rotary shaft being parallel to the axial direction of the wheel shaft, the driving section being positioned in the cavity, the free ends of the brake members touching two sides of the driving section, whereby when the rotary shaft is rotated, the driving section drives the two brake members;

a rocking arm positioned on an outer side of the casing, another end of the rotary shaft extending through the casing to connect with the rocking arm, whereby the rocking arm is synchronously rotatable with the rotary shaft;

a controlling assembly connected with the rocking arm and manually controllable for controlling swinging of the rocking arm; and an annular wall projecting from an inner side of the wheel, the casing covering the annular wall with the annular wall accommodated in the cavity, the two brake members being positioned in the annular wall, the brake linings being spaced from the inner face of the annular wall;

whereby the brake structure is hidden in the wheel and by means of operating the controlling assembly, the rotary shaft rotates such that the driving section drives the free ends of the brake members and stretches open the brake members and under such circumstance, the brake linings exert a frictional force against the inner face of the annular wall to create brake effect.

2. Brake structure as claimed in claim 1, further comprising a fixing member which is a plate body fixedly disposed on the inner side of one end of the wheel shaft without rotating, after the casing is fitted on the wheel shaft, the casing being fixedly connected with the fixing member.

3. Brake structure as claimed in claim 2, wherein a projecting plate is disposed on inner side of one end of the wheel shaft, the fixing member having an insertion section inserted in the projecting plate.

4. Brake structure as claimed in claim 2, wherein the other end of the rotary shaft has a key section projecting out of the fixing member to connect with the rocking arm.

5. Brake structure as claimed in claim 4, wherein the wall of the casing is formed with a through hole and the fixing member is formed with a through hole corresponding to the through hole of the casing, the diameter of the through hole of the casing being larger than that of the through hole of the fixing member, the outer diameter of the key section being smaller than that of the rotary shaft, the rotary shaft being rotatably fitted through the through hole of the casing without extending through the through hole of the fixing member, the key section extending out of the through hole of the fixing member to connect with the rocking arm.

6. Brake structure as claimed in claim 1, wherein the resilient member is a circular metal wire, two ends of the resilient member being respectively connected with the two brake members.

7. Brake structure as claimed in claim 1, wherein the other end of the rotary shaft has a key section projecting out of the casing, the rocking arm having a key hole in which the key section is fitted.

8. Brake structure as claimed in claim 1, wherein the driving section has two flat faces on an outer circumference thereof.

* * * * *